US007003854B2

(12) United States Patent
Takabayashi et al.

(10) Patent No.: US 7,003,854 B2
(45) Date of Patent: Feb. 28, 2006

(54) COVER AND DECORATIVE COVER FOR A CLIP AND CLIP SET AND A NAIL COVER IN COMBINATION WITH A PLASTIC CLIP

(75) Inventors: Masaki Takabayashi, Kyoto (JP); Eijiro Taki, Kyoto (JP); Taizo Noda, Nishinomiya (JP)

(73) Assignees: Decos Co., Ltd., Kyoto (JP); j-sen ltd., Kyoto (JP)

( * ) Notice: Subject to any disclaimer, the term of this patent is extended or adjusted under 35 U.S.C. 154(b) by 0 days.

(21) Appl. No.: 10/765,969

(22) Filed: Jan. 29, 2004

(65) Prior Publication Data

US 2004/0205943 A1 Oct. 21, 2004

(30) Foreign Application Priority Data

Apr. 21, 2003 (JP) ..... 2003-116194

(51) Int. Cl.
*A44B 21/00* (2006.01)

(52) U.S. Cl. ..... 24/504

(58) Field of Classification Search ..... 24/457, 24/458, 499, 504, 3, 11, 297, 503, 334, 516, 24/113 R, 515, 113 MP; 132/73; 623/54, 623/57

See application file for complete search history.

(56) References Cited

U.S. PATENT DOCUMENTS

| | | | | | |
|---|---|---|---|---|---|
| 277,700 | A * | 5/1883 | Foster | ..... | 24/504 |
| 3,914,828 | A * | 10/1975 | Noda | ..... | 24/504 |
| 4,086,686 | A * | 5/1978 | Takabayashi | ..... | 24/504 |
| 4,445,234 | A * | 5/1984 | Ogunro | ..... | 623/54 |
| 4,559,055 | A * | 12/1985 | Ogunro | ..... | 132/73 |
| 4,608,838 | A * | 9/1986 | Gardner | ..... | 63/40 |
| 5,044,175 | A * | 9/1991 | Razza | ..... | 63/20 |
| 5,400,483 | A * | 3/1995 | Noda | ..... | 24/499 |
| 5,413,123 | A * | 5/1995 | Aylott et al. | ..... | 132/73 |
| 5,778,497 | A * | 7/1998 | Noda | ..... | 24/504 |
| 6,260,244 | B1 * | 7/2001 | Noda | ..... | 24/499 |
| 6,327,757 | B1 | 12/2001 | Noda | | |
| 6,488,506 | B1 * | 12/2002 | Grace et al. | ..... | 132/73 |

* cited by examiner

*Primary Examiner*—Robert J. Sandy
(74) *Attorney, Agent, or Firm*—Snider & Associates; Ronald R. Snider

(57) ABSTRACT

An artificial nail or decorative cover is used to cover a clip set. The clip set combines the nail cover or decorative cover with a plastic clip. The nail cover is a cover body with an outer surface curved like a human nail and has a wall running sideways at an inner surface of the cover. A fitting ditch between the inner surface of the cover and the thin plate wall is provided on the thin plate wall. This artificial nail cover or decorative cover can be also attached with the plastic clip to cover the clip set.

11 Claims, 17 Drawing Sheets

COVER AND DECORATIVE COVER FOR A CLIP AND CLIP SET AND A NAIL COVER IN COMBINATION WITH A PLASTIC CLIP

RELATED APPLICATION

This Present disclosure relates to subject matter contained in Japanese Patent Application No. 2003-116194 (filed on Apr. 21, 2003) which is expressly incorporation herein by reference in its entirety.

BACKGROUND OF THE INVENTION

This invention relates to an artificial nail cover and decorative cover for a clip and a clip set in combination with a nail cover and a plastic clip.

As is well known, the artificial nail cover having an external surface curved in a convex shape like human nail is very popular among young women and is used as an accessory. The artificial nail cover comprises of a nail cover body which is adhesively fixed on human nail and a ring which is to be inserted into a finger. Also, such decorative artificial nail cover is provided with said nail cover body and ring which are connected to each other by a chain.

On the other hand, a handy cellular phone can be said to be one of their daily necessaries among the young women, and it is their fashion to attach a strap to cellular phone in various designs which satisfies their taste. The strap has a clip used on clothes as a shirt clip in order to hold the cellular phone. The clip comprises of two clipping plates where a display board is furnished on the one side of the plate, and a hook is provided on the other side of clipping plate wherein a hook is connected with a fastening cord in order to form a strap with a clip. Thus, the strap is equipped with the clip whereas the strap is conveniently used for the cellular phone.

One of the inventors has already obtained a U.S. Pat. No. 6,327,757 in which he discloses a plastic clip to be used on clothes. This patent is now cited as a Prior Art in the drawings at FIG. 25 and FIG. 26. FIG. 25A, 25B and 25C are exploded drawings for the plastic clip. FIG. 25A shows an upper clipping member(31) and FIG. 25B is a lower clipping member (30), while FIG. 25C is an operation member (32). With regard to FIG. 25C, this figure represents a back side so that components may be seen clearly. FIG. 26 is a longitudinal sectional view of assembled three members of the plastic clip of FIG. 25 along a line running lengthwise just separated from a center line but parallel to the center line. As shown in FIG. 25 and FIG. 26, this clip comprises the lower clipping member (30), the upper clipping member (31) to be seated over the lower clipping member (30) and the operation member (32) to be inserted on a rear portion of the upper clipping member (31). Toward a top end of the lower clipping member (30) joining with an end of the upper clipping member (31), clipping teeth (33) are formed, and the plastic clip (34) is opened or closed by rotation movement of the operation member (32) while the teeth (33) are actuated by this movement. This plastic clip (34) comprises a lower clipping board (30), which has an external convex surface curved in the shape of a human nail, by forming a fitting window (35) in rear position and prepares a pair of side wall (36) on both sides of said fitting window (35) and the support axis (37) is established on the inside of the side walls (36); an upper clipping board (31) which establishes a recessed auxiliary plate (38) on rear position which fits into a fitting window (35) of said lower clipping board (30); and the operation member (32) which would open and close a top of clipping teeth (33) of upper clipping board (31) and lower clipping board (30) by rotating a rear portion (40) which rotates centering on the support axis (37), the auxiliary plate (38) of upper clipping board (31) is inserted from front of the lower clipping board (30) toward the lower direction of the support axis (37) to fit into the fitting window (35) of the lower clipping board (30) and while keeping this condition the front portion (39) is inserted from rear direction of the upper clipping board (31) toward the lower direction of the support axis (37).

THE SUMMARY OF THE INVENTION

The objective of the present invention is to provide an artificial nail for covering a clip to apply the same to a cellular phone, while the artificial nail cover has various fashionable designs popular to among young women. In addition, other decorative covers may be used for covering the clip in accordance with this invention.

The other objective of the invention is to provide a clip set combining this nail cover with a plastic clip.

In order to realize these objectives, the present inventors have conducted numerous studies, various researches, and experiments. As a result, they have arrived at the following points:

1) A strap is attached to the cellular phone.
2) The strap has a clip that is clipped on clothes to hold the cellular phone.
3) The clip, for instance, was disclosed by one of the present inventors as U.S. Pat. No. 6,327,757, and this disclosed clip has a lower clipping member which bears a close resemblance to the artificial nail cover in its shaping.

The prior art clip, as shown in FIG. 25 and FIG. 26, comprises a lower clipping member and an upper clipping member placed on the lower clipping member and an operation member inserted into rear portion of the upper clipping member. The upper clipping member has a curved outer surface like a real human nail which is similar to the artificial nail cover, and therefore the artificial nail cover is easily attached to the clip. Also, a functional strap becomes a more fashionable strap. The strap is now provided with a nail that will provide an enjoyable coordination purpose. At the same time, the artificial nail cover or decorative clip cover has a useful function wherein it provides a protective cover for the clip which prevents waste threads in a form of cotton dust from clogging and coming into a gap formed between the fitting window (35) of the lower clipping member (30) and the auxiliary plate (38) of the upper clipping member (31).

The artificial nail cover for covering a clip set of this invention has a surface curved like that of a human nail and also has a cover body. A thin plate wall is formed on an inner surface of the cover body which runs in a direction of a short dimension of a cover body. A fitting ditch is also formed along the thin plate wall in between an inner wall of the cover body.

On the other hand, the artificial nail cover for a clip in this invention has a cover body which is curved on the outer surface like the human nail, and toward a rear portion of the cover body a pair of side walls extending downward which are formed facing each other. The thin plate wall is also established in the inside of the cover body running between both side walls, while the fitting ditch is prepared in between an inner surface of the cover body and in this thin plate wall.

In each of the artificial nail covers as explained above, this invention describes the fitting ditch is formed with a proper curve along the inner surface of the cover body.

The artificial nail cover for a clip is to be placed on one clipping member of the plastic clip. One member of the plastic clip has a curved outer surface like the human nail, and a fitting window is formed in its rear portion and a pair of side walls is prepared on both sides of the window while in inner sides of the side walls a support axis is established. In the other clipping member, a recessed auxiliary plate is formed, and it is to be fitted into the fitting window of one clipping member. When the auxiliary plate is rotated centering on the support axis, the auxiliary plate is forcibly pressed and an operation member drives ends of both clipping members to be opened or closed. Thus, in this plastic clip, by the rotating movement of the operation member, the auxiliary plate comes fittingly into the fitting window, which results the opening and closing action between one clipping member and the other clipping member. The artificial nail cover has the curved outer surface and the cover body extending toward the end of the nail. The thin plate wall is formed on the inner surface of the cover body while the fitting ditch is also formed on the thin plate wall below the inner surface of the cover body. When the thin plate body is inserted into the fitting window of one clipping member and the fitting ditch is to be pushed onto a front end of the fitting window, and thus the cover body is placed on the outer surface of one clipping member.

Further, a clip set combining the artificial nail cover with the plastic clip by this invention is composed followingly.

The plastic clip comprises: One clipping member which has an outer surface curved like a human nail, and in its rear portion it has a fitting window which has a pair of side walls on both sides of a window and has also a support axis in the inner surface of the side wall. The other clipping member has in its rear portion a recessed auxiliary plate which should be fitted with the fitting window. The operation member is combined with one clipping member and the other clipping member, pushing the auxiliary plate forcibly into the window and it is rotated centering on the support axis. When the auxiliary plate comes into the fitting window by the rotation movement, both ends of one clipping member and the other clipping member are adapted to be closed.

The artificial nail cover for a clip comprises : The cover body having a shape curved like the human nail, and toward the rear portion a pair of side walls extending downward which are formed while between the side walls formed the thin plate wall along which the fitting ditch is prepared.

The plastic clip and the artificial nail cover are combined for the clip set. The thin plate wall of the cover is inserted into the fitting window of the plastic clip and then, the fitting ditch is also pushed into the front end of the window. Thus, the cover body is placed over the outer surface of one clipping member, and through the rotation movement of the operation member, the auxiliary plate is fitted forcefully into the fitting window, and it results to fix the artificial nail cover tightly, preventing the cover from falling off the plastic clip.

BRIEF DESCRIPTION OF THE DRAWINGS

FIG. 25 (*b*) is a perspective view of the exploded lower clipping member by the prior art.

FIG. 25 (*c*) is a perspective view of the exploded operation member.

DESCRIPTIONS OF THE PREFERRED EMBODIMENT

Based on offered drawings, preferred embodiments are explained as follows.

First Embodiment

Figure 1:
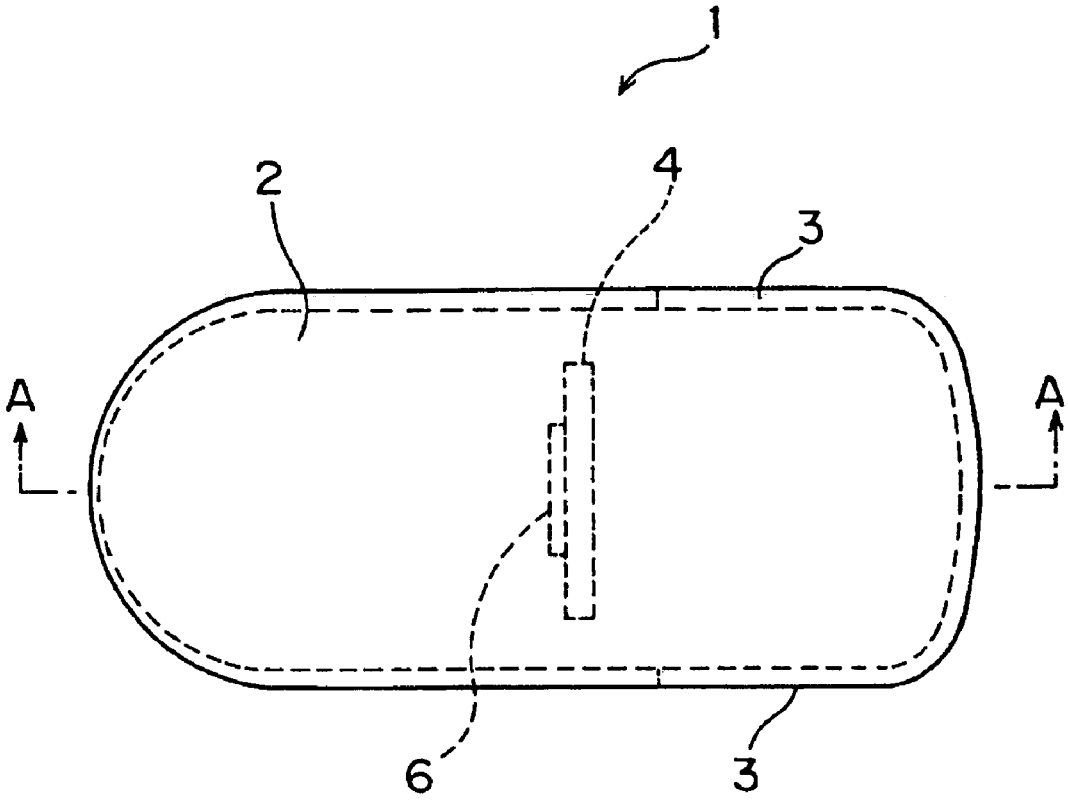
FIG. 1 is a plan view of an artificial nail cover for a clip by this invention.
Figure 2:
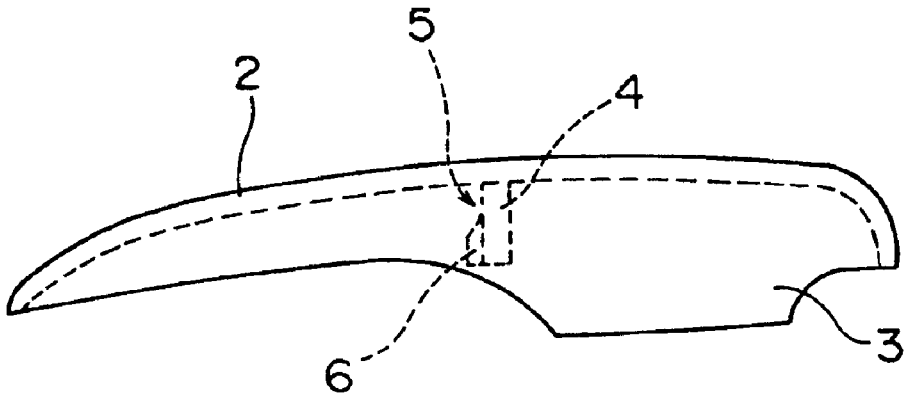
FIG. 2 is a side view of the artificial nail cover.
Figure 3:
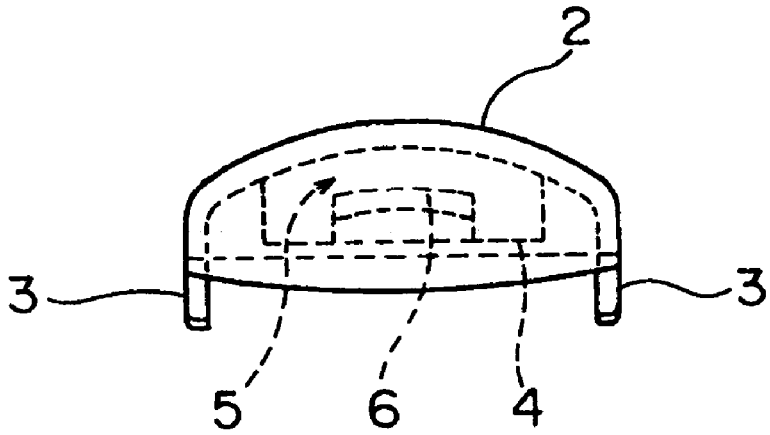
FIG. 3 is a front view of the artificial nail cover.
Figure 4:
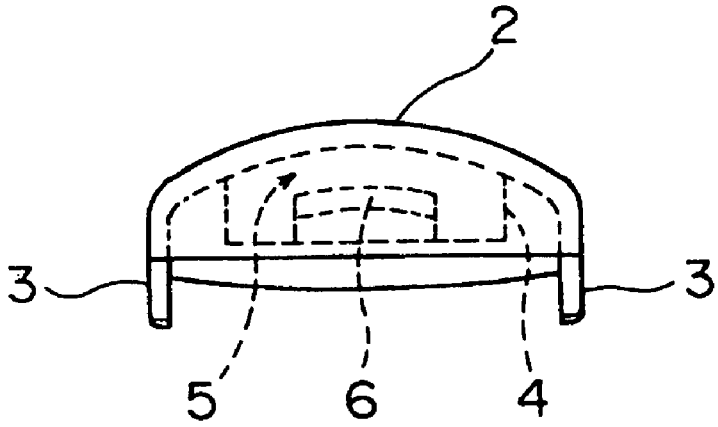
FIG. 4 is a rear view of the artificial nail cover.
Figure 5:
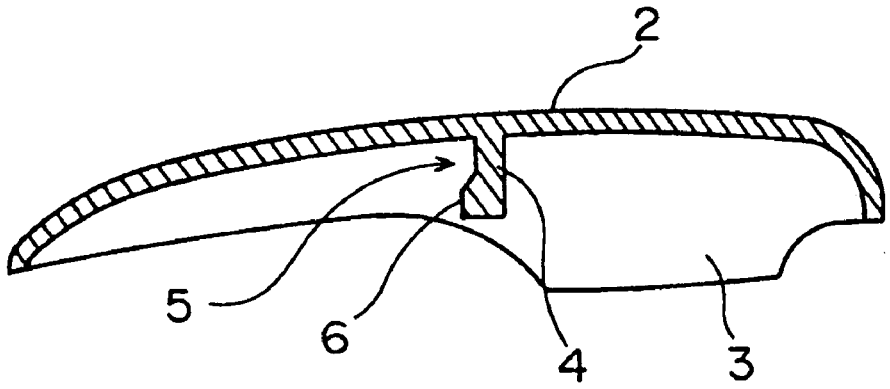
FIG. 5 is a longitudinal sectional view of the artificial nail cover along the line A—A shown in FIG. 1.

FIG. 1 is a plan view showing an embodiment of an artificial nail cover for a clip, and FIG. 2 is a side view of the nail cover, while FIG. 3 is a front view of the nail cover. FIG. 4 is a rear view of the artificial nail cover and FIG. 5 is a longitudinal sectional view of the nail cover along the line A—A shown in FIG. 1. In these figures, the numeral 1 is the artificial nail cover for a clip, and it has a cover body (2) extending lengthwise toward an end of the cover body (2) and it provides a curved surface in its outer surface like a human nail. A pair of side walls (3) is formed directing downward on a rear portion of the cover body (2) with each side wall (3) facing the other. A thin plate wall (4) is formed under a surface of the cover body (2) and the thin wall (4) runs sideways between the side walls (3). On the thin plate wall (4), a protruding project (6) is formed, whereby a fitting ditch (5) is prepared over the thin plate wall (4) a little bit apart from the inner surface of the cover body (2), and the project (6) provides a curved face along the surface.

Figure 6:
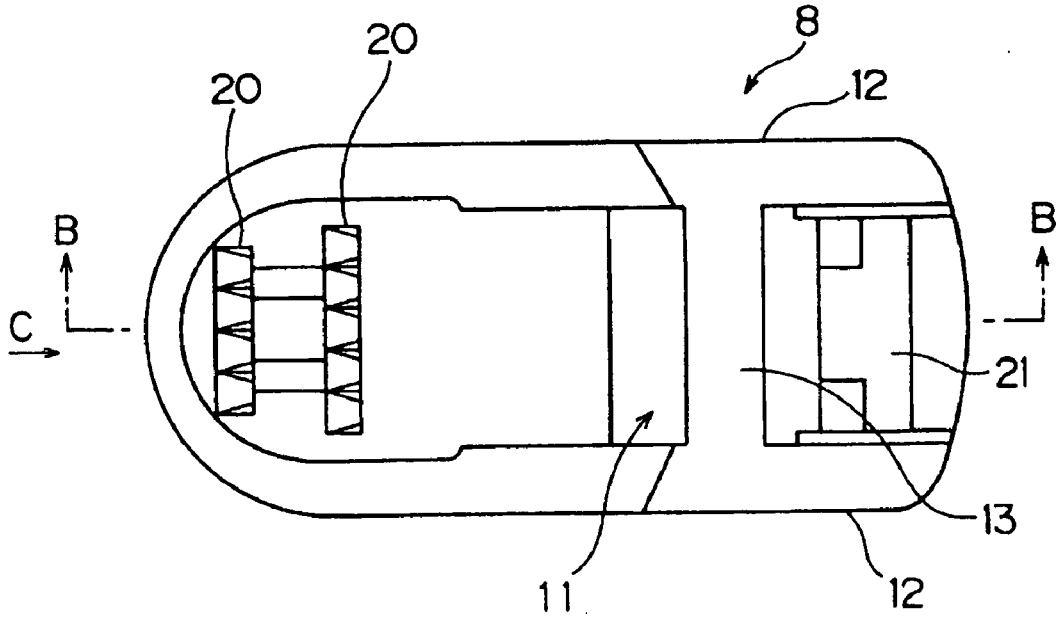
FIG. 6 is a plan view of a lower clipping member in a plastic clip.
Figure 7:
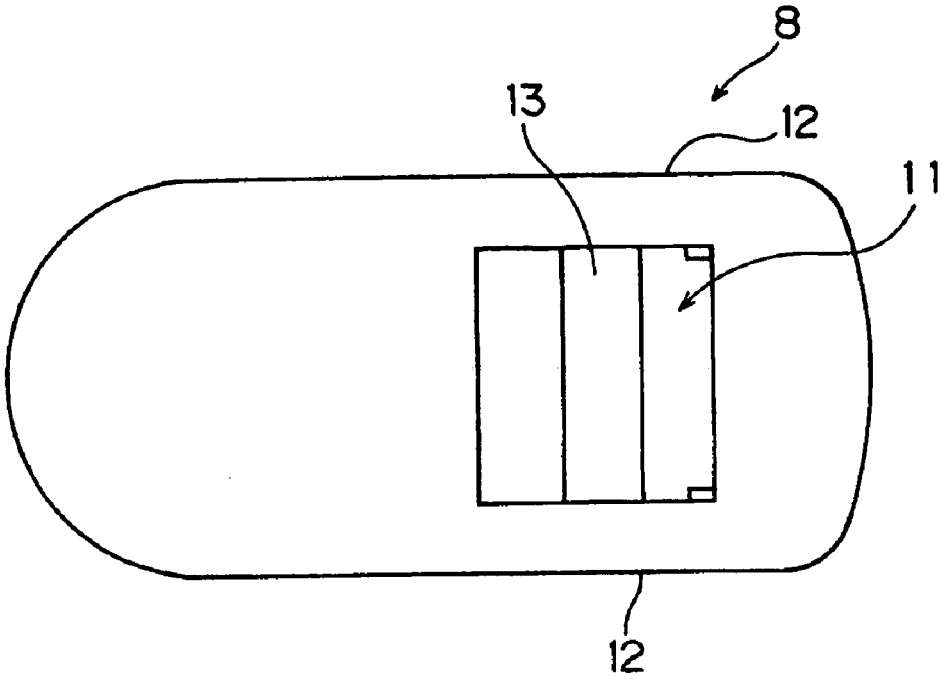
FIG. 7 is a bottom view of the lower clipping member of FIG. 6.
Figure 8:
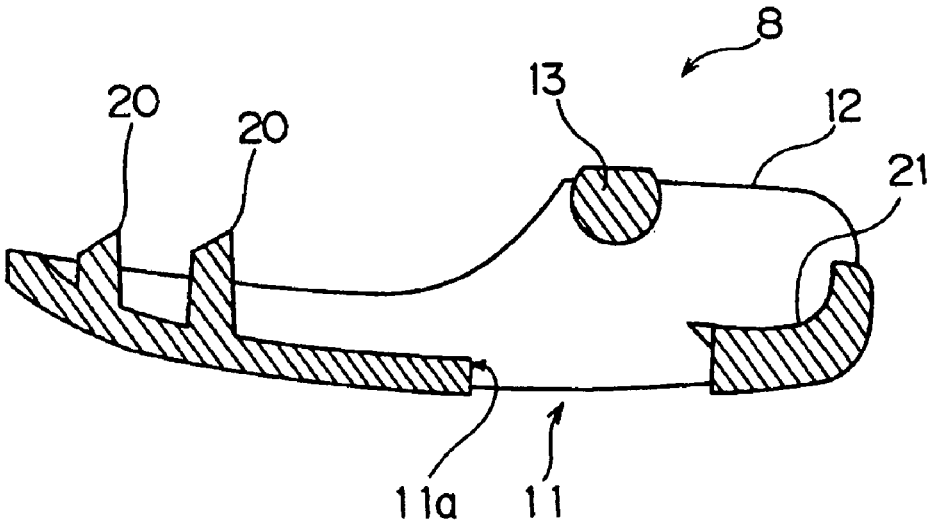
FIG. 8 is a longitudinal sectional view of the lower clipping member along the line B—B shown in FIG. 6.
Figure 9:
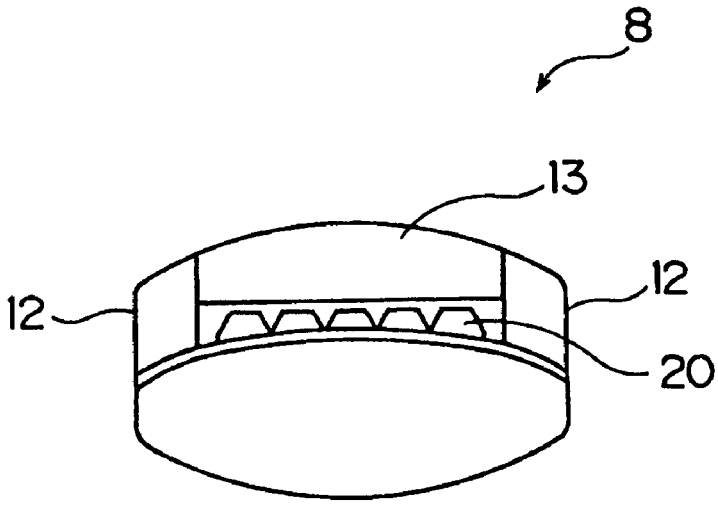
FIG. 9 is a front view of the lower clipping member seen from an arrow C shown in FIG. 6.
Figure 10:
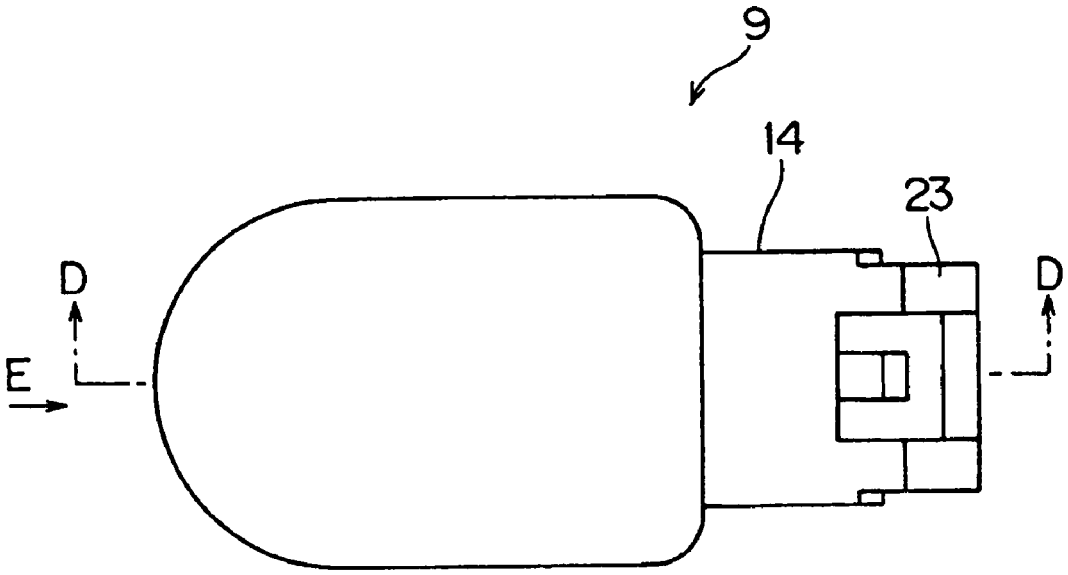
FIG. 10 is a plan view of an upper clipping member in the plastic clip.
Figure 11:
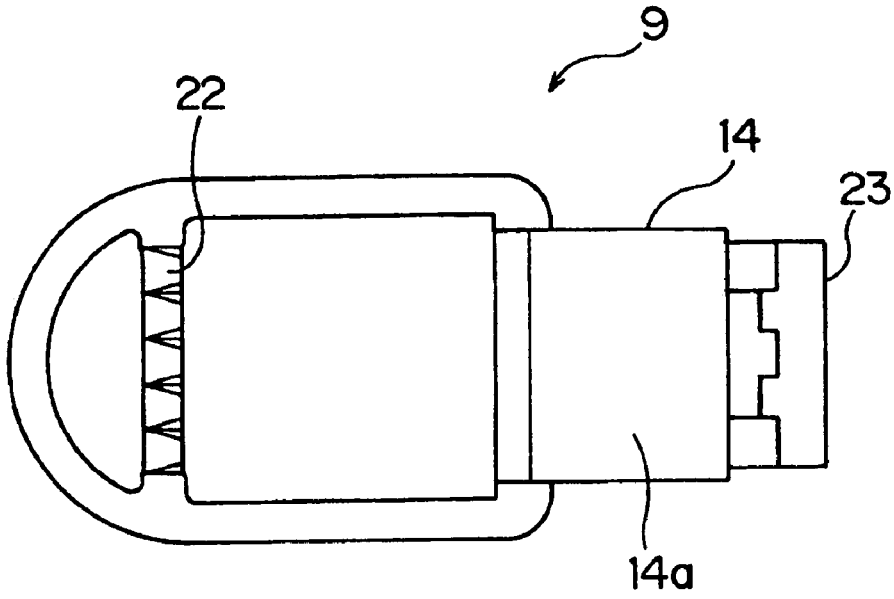
FIG. 11 is a bottom view of the upper clipping member of FIG. 10.
Figure 12:
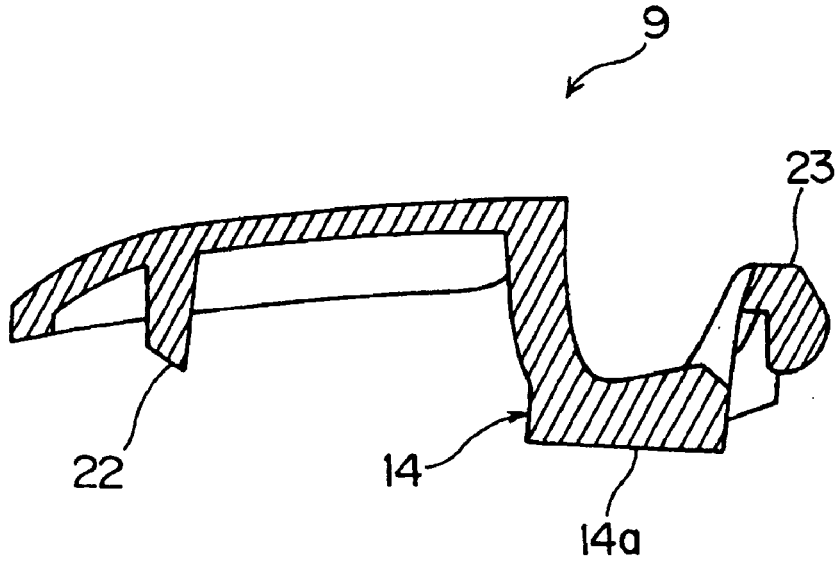
FIG. 12 is a longitudinal sectional view of the upper clipping member along the line D—D shown in FIG. 10.
Figure 13:
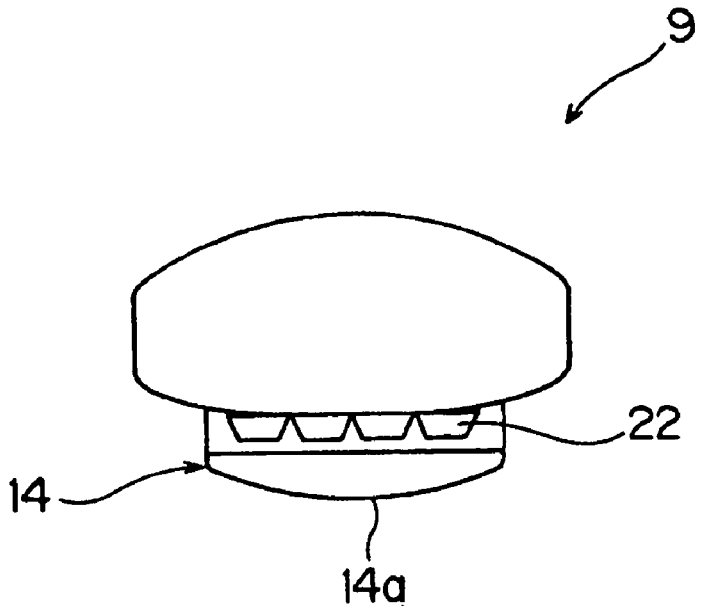
FIG. 13 is a front view of the upper clipping member seen from an arrow E shown in FIG. 10.
Figure 14:
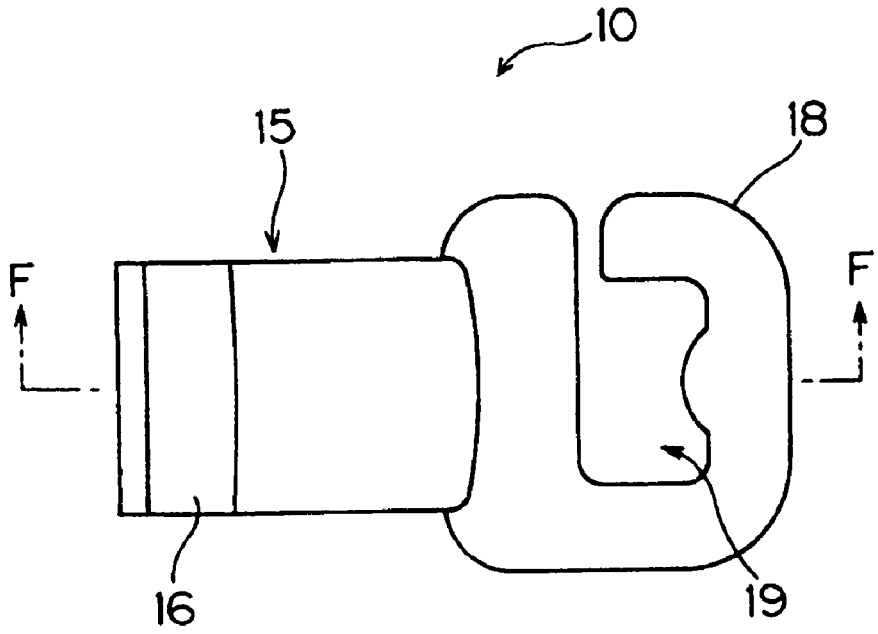
FIG. 14 is a plan view of an operation member in the plastic clip.
Figure 15:
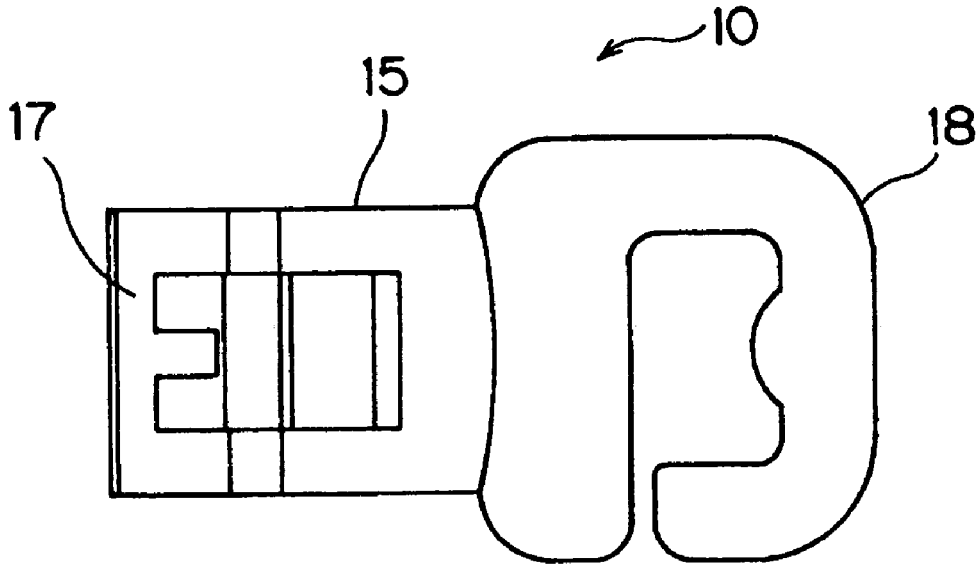
FIG. 15 is a bottom view of the operation member of FIG. 14.
Figure 16:
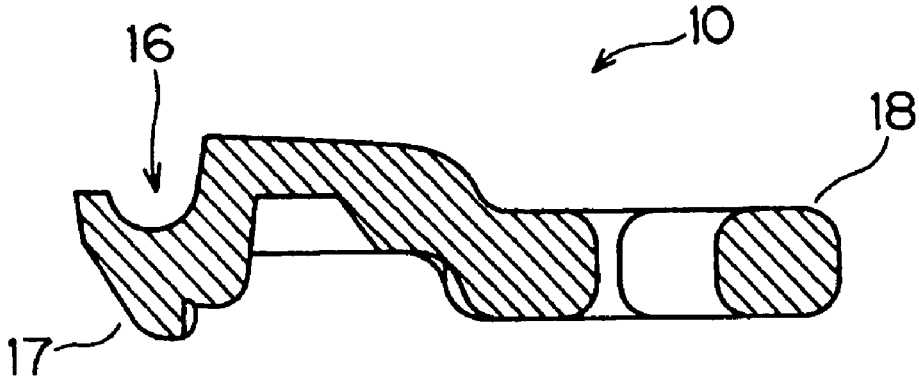
FIG. 16 is a longitudinal sectional view of the operation member along the line F—F shown in FIG. 14.
Figure 17:
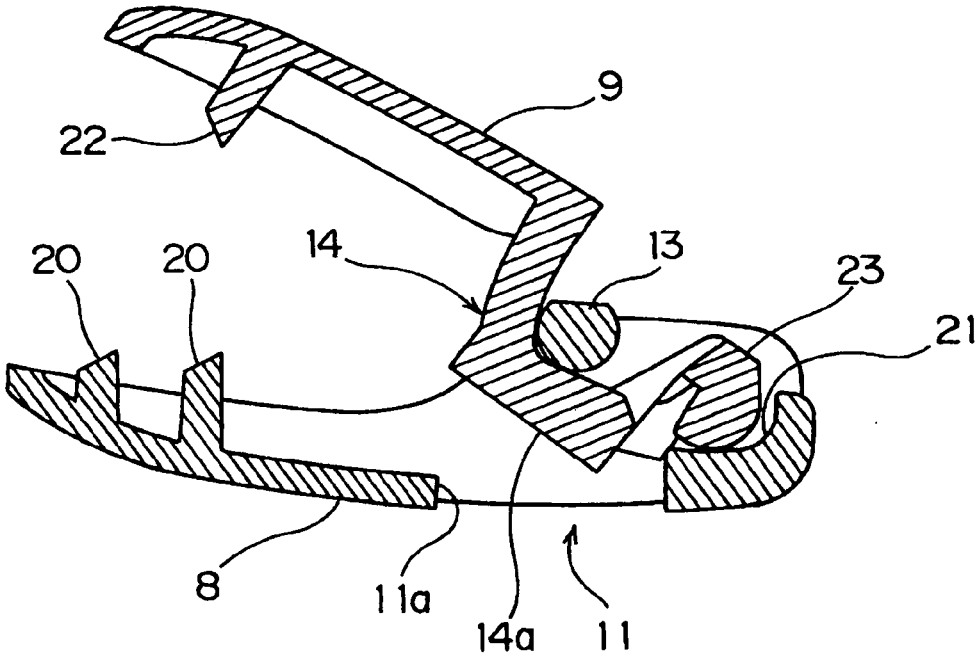
FIG. 17 is a longitudinal sectional view for a connection between the lower clipping member and the upper clipping member, wherein an auxiliary plate in the upper clipping member is pushed downward into a support axis in the lower clipping member from the front portion of the lower member.
Figure 18:
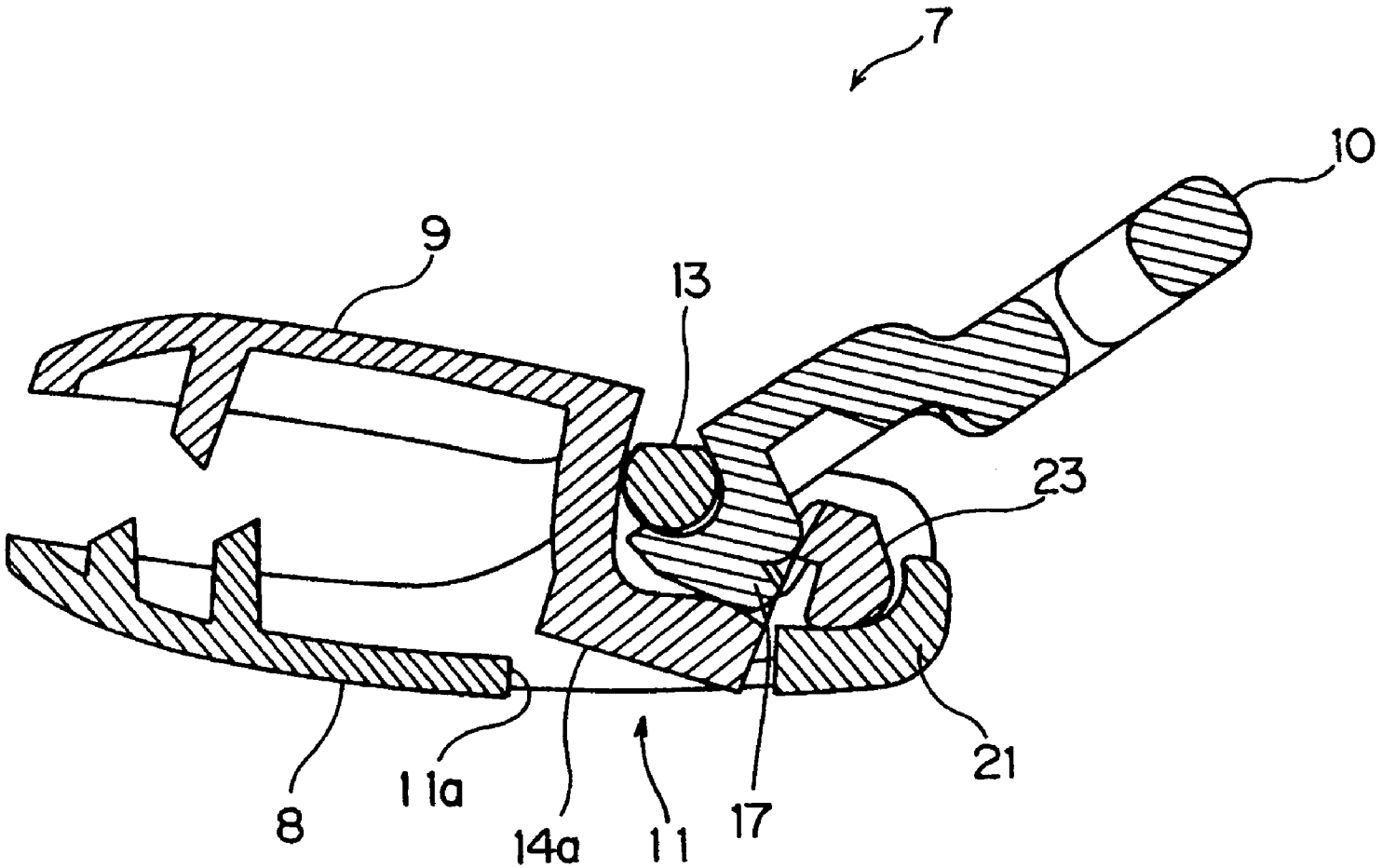
FIG. 18 is a longitudinal sectional view for the connection between the lower clipping member, the upper clipping member and an operation member, wherein the auxiliary plate in the upper clipping member is placed at a fitting window in the lower clipping member and the front portion of the operation member is forcibly pushed toward to the support axis from the rear portion of the upper clipping member.
Figure 19:
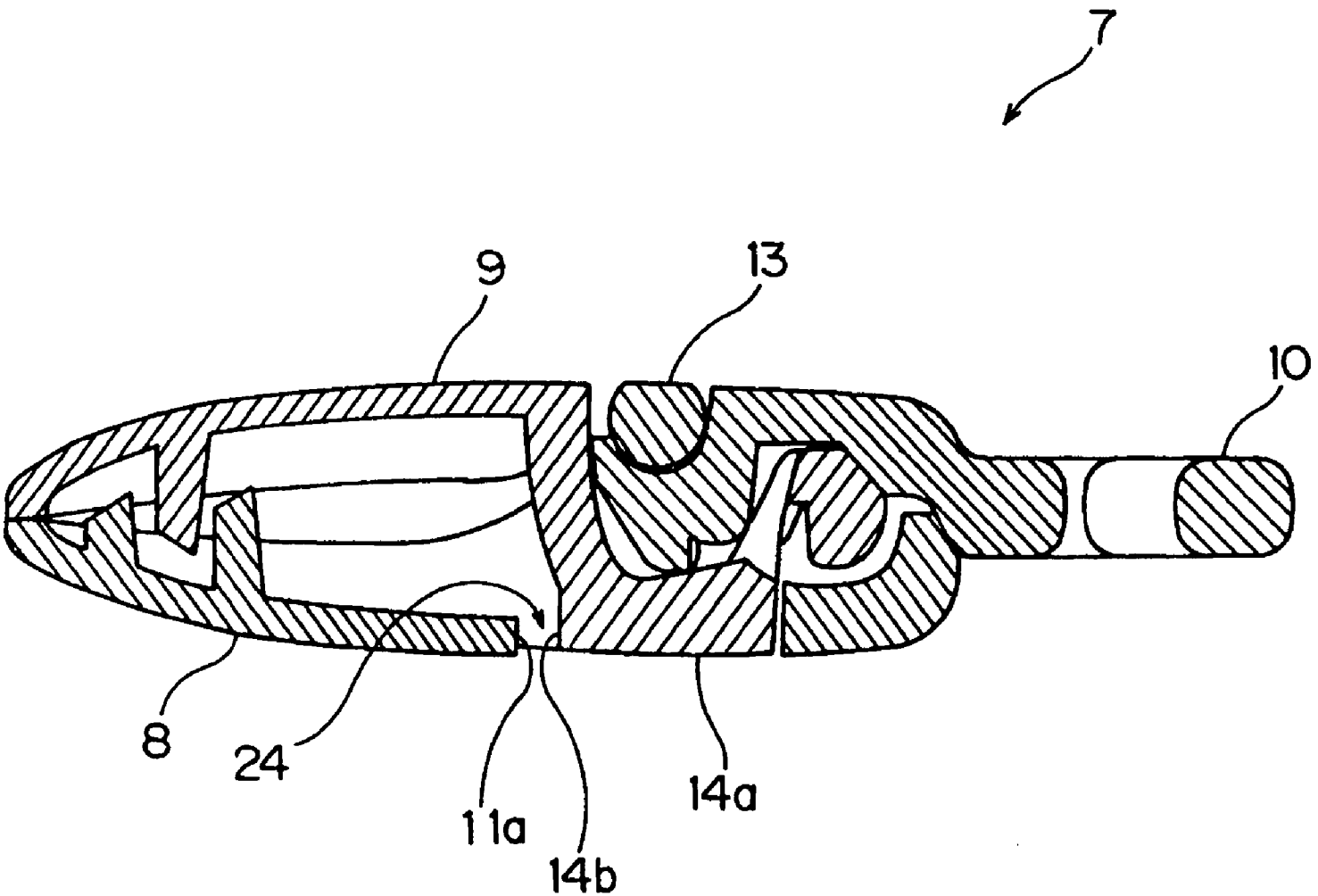
FIG. 19 is a longitudinal sectional view wherein both ends of the lower and the upper clipping members close together with clipping teeth.
Figure 20:
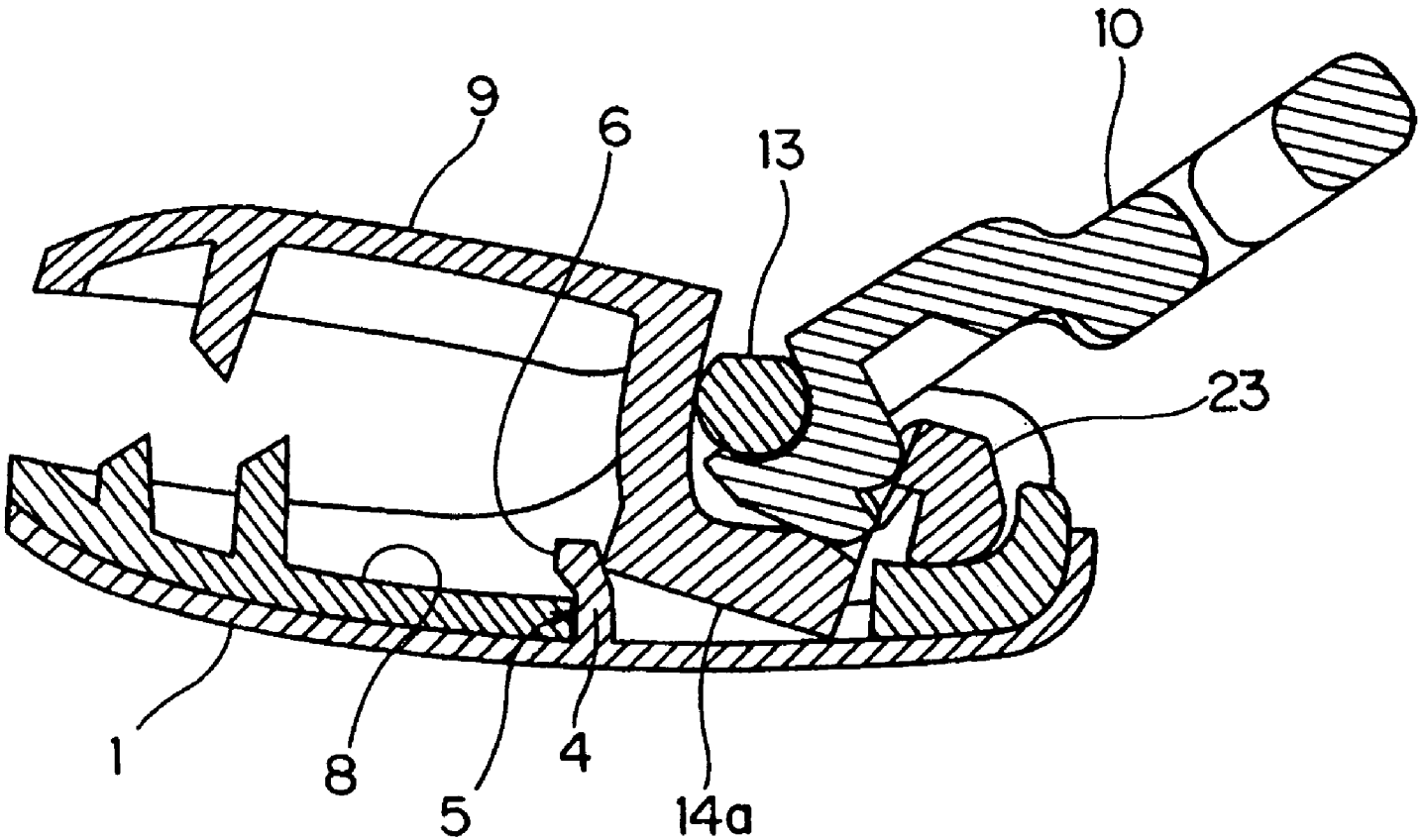
FIG. 20 is a longitudinal sectional view wherein the artificial nail cover is attached with the lower clipping member of the plastic clip.
Figure 21:
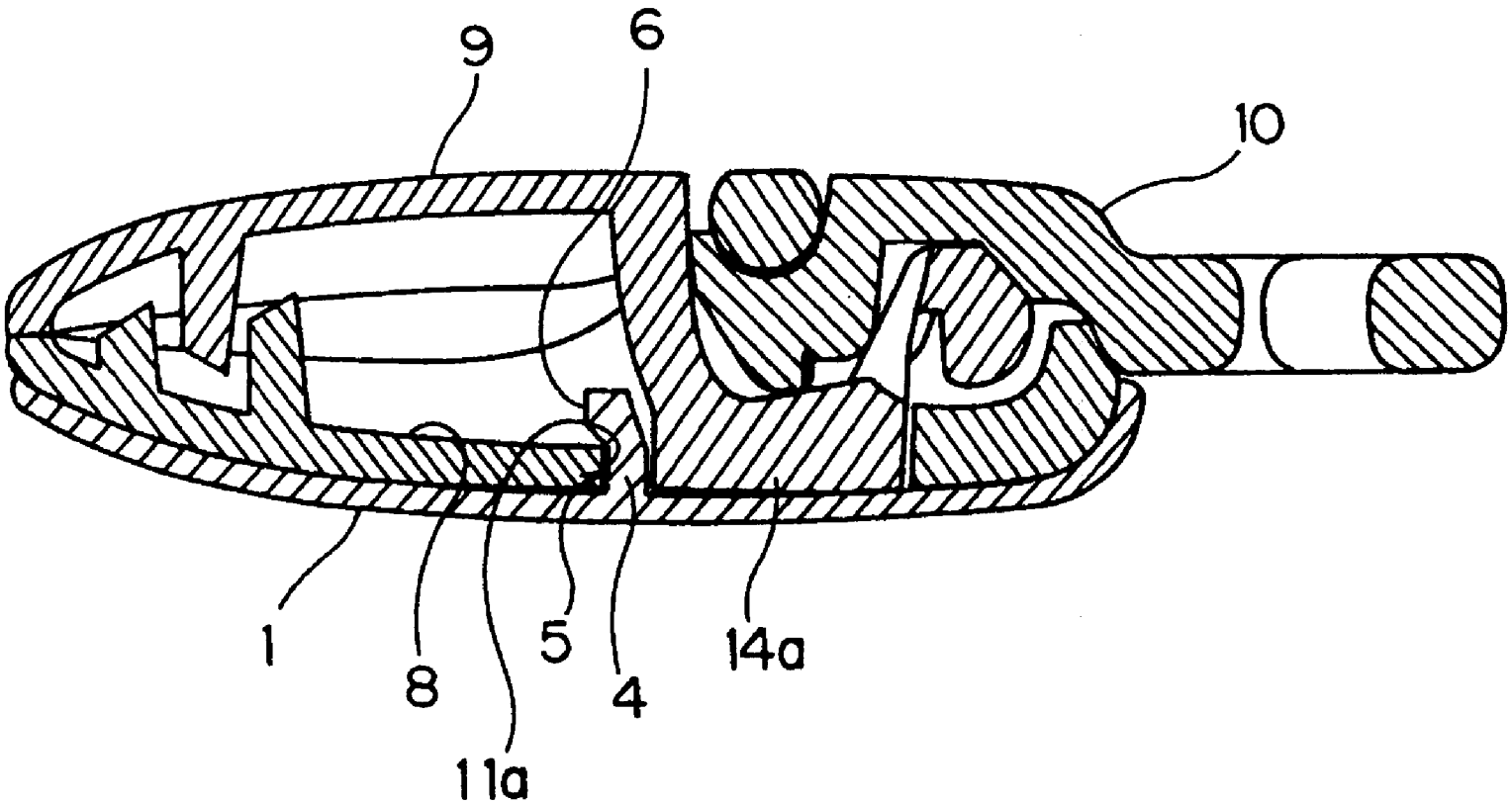
FIG. 21 is a longitudinal sectional view wherein the ends of the plastic clip are closed after the attachment shown in FIG. 20.
Figure 22:
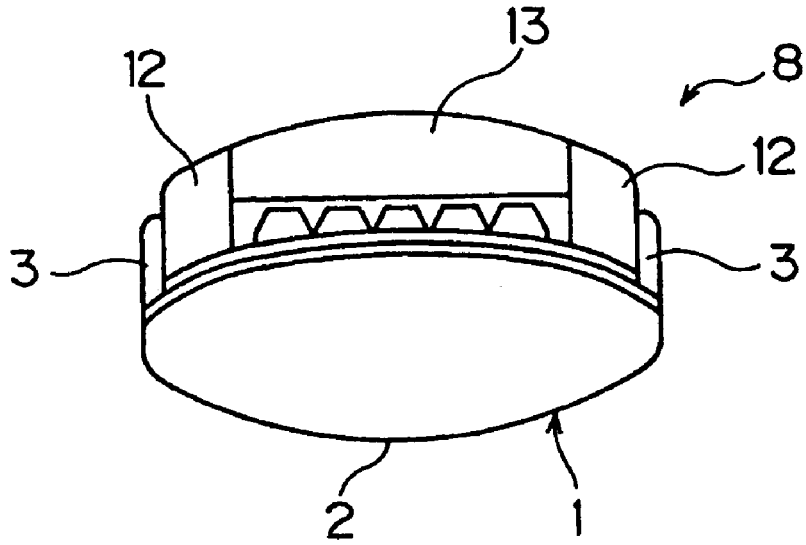
FIG. 22 a front view wherein the artificial nail cover is attached with the lower clipping member shown in FIG. 6.

Next, a plastic clip (7) onto which the artificial nail cover is attached is explained. FIG. 6 shows a plan view of a lower clipping member (8) of the plastic clip (7), while FIG. 7 is a bottom view of the lower clipping member (8). FIG. 8 is a longitudinal section view of the lower member (8) along the line B—B shown in FIG. 6, while FIG. 9 is a front view of the lower clipping member (8) seen from an arrow C shown also in FIG. 6. FIG. 10 shows a plan view of an upper clipping member (9) of the plastic clip (7), while FIG. 11 is a bottom view of the upper clipping member (9). FIG. 12 shows a longitudinal sectional view of the upper clipping member (9) along the line D—D shown in FIG. 10, while FIG. 13 is a front view of the upper clipping member (9) seen from an arrow E also shown in FIG. 10. FIG. 14 shows a plan view of an operation member (10), while FIG. 15 is a bottom view of the operation member (10). FIG. 16 shows a longitudinal sectional view of the operation member (10) along the line F—F shown in FIG. 14. FIG. 17 is a longitudinal sectional view for a connection between the lower clipping member (8) and the upper clipping member (9), wherein an auxiliary plate (14) in the upper clipping member (9) is pushed into a lower portion of a support axis (13) in the lower clipping member (8) from the front portion of the lower member (8). FIG. 18 shows a longitudinal sectional view for the connection between the lower clipping member (8), the upper clipping member (9) and an operation member (10), wherein the auxiliary plate (14) is placed at a combining window (11) and the front portion of this operation member (10) is forcibly pushed toward the support axis (13) from the rear portion of the upper clipping member (9). FIG. 19 shows a longitudinal sectional view wherein both ends of the lower member (8) and the upper member (9) close together with clipping teeth (20). FIG. 20 is a longitudinal sectional view wherein the artificial nail cover (1) is attached with the lower clipping member (8) of the plastic clip (7). FIG. 21 is a longitudinal sectional view wherein the end of the plastic clip (7) is closed after the attachment shown in FIG. 20. FIG. 22 is a front view wherein the artificial nail cover (1) is attached with the lower clipping member (8) as shown in FIG. 6.

With the reference to FIG. 18, onto the plastic clip (7) the artificial nail cover for a clip (1) can be attached. Referring to FIG. 6~FIG. 16, this clip (7) comprises the lower clipping member (8) and the upper clipping member (9) to be placed over the lower member (8) and the operation member (10) to be inserted into the rear portion of the upper clipping member (9). This constitution is quite similar to a clip (34) in the prior art shown in FIG. 25 and FIG. 26. An outer surface of the lower clipping member (8) provides a curved and convex face like a human nail, and a combining window (11) in a rectangle shape is formed. On both sides of the window (11), a pair of side walls (12) is established, and in the inner surface of the wall (12), a support axis (13) is built. The outer surface of the upper clipping member (9) provides a curved and convex shape like the human nail, and in its rear portion, a recessed auxiliary plate (14) which is formed to be fitted by leaving some free space to the combining window (11) in the lower clipping board (8). A lower portion (14*a*) composes the lower surface of the auxiliary plate (14) and is in rectangle shape in order to come properly into the combining window (11). In a front portion (15) of the operation member (10), a gutter-like axis receiver (16) is prepared transversely and the gutter-like axis receiver (16) is to be fitted onto the support axis (13) in the lower clipping member (8). Below the gutter-like axis receiver (16), a cam (17) is formed so that the cam is adapted to push an upper face of the auxiliary plate (14), while in a rear portion (18) of the operation member (10), and also in the rear portion (18), a strap insertion hole (19) is formed to be connected with a strap (not shown in the drawing). Clipping teeth 20 are prepared in the end of the lower clipping member (8). A support shelf 21 promotes opening and closing the upper clipping member (9) by the rotating movement of the operation member (10). A corresponding tooth 22 is formed on an end of the upper clipping member (9), and this tooth is combined with a pair of teeth (20) prepared in the lower clipping member (8). When the support shelf (21) moves along a contacting axis (23), the end of the upper clipping member (9) is accordingly opened or closed.

With reference to FIG. 17, in the plastic clip (7), the auxiliary plate (14) of the upper clipping member (9) is inserted downward into the support axis (13) from the front portion of the lower clipping member (8) and the plate (14) is placed into the combining window (11). Then, as shown in FIG. 18, after the contacting axis (23) of the upper clipping member (9) is placed on the support shelf (21) of the lower clipping member (8), the axis receiver (16) of the operation member (10) is fitted into the support axis (13) and the operation member (10) is rotated downward centering on the support axis (13). At the same time, the cam (17) of the operation member (10) is maintained in condition just before the cam (17) is placed over the upper face of the auxiliary plate (14). This condition keeps both ends of the lower clipping member (8) and the upper clipping member (9) as opened. With regard to FIG. 19, when the cam (17) of the operation member (10) is placed over the auxiliary plate (14) of the upper clipping member (9) and the lower clipping member (8) and the three members, the lower clipping member (8), the upper clipping member (9) and the operation member (10), stay on one line, the both ends of the lower clipping member (8) and the upper clipping member (9) are kept in the status as closed.

Figure 25:
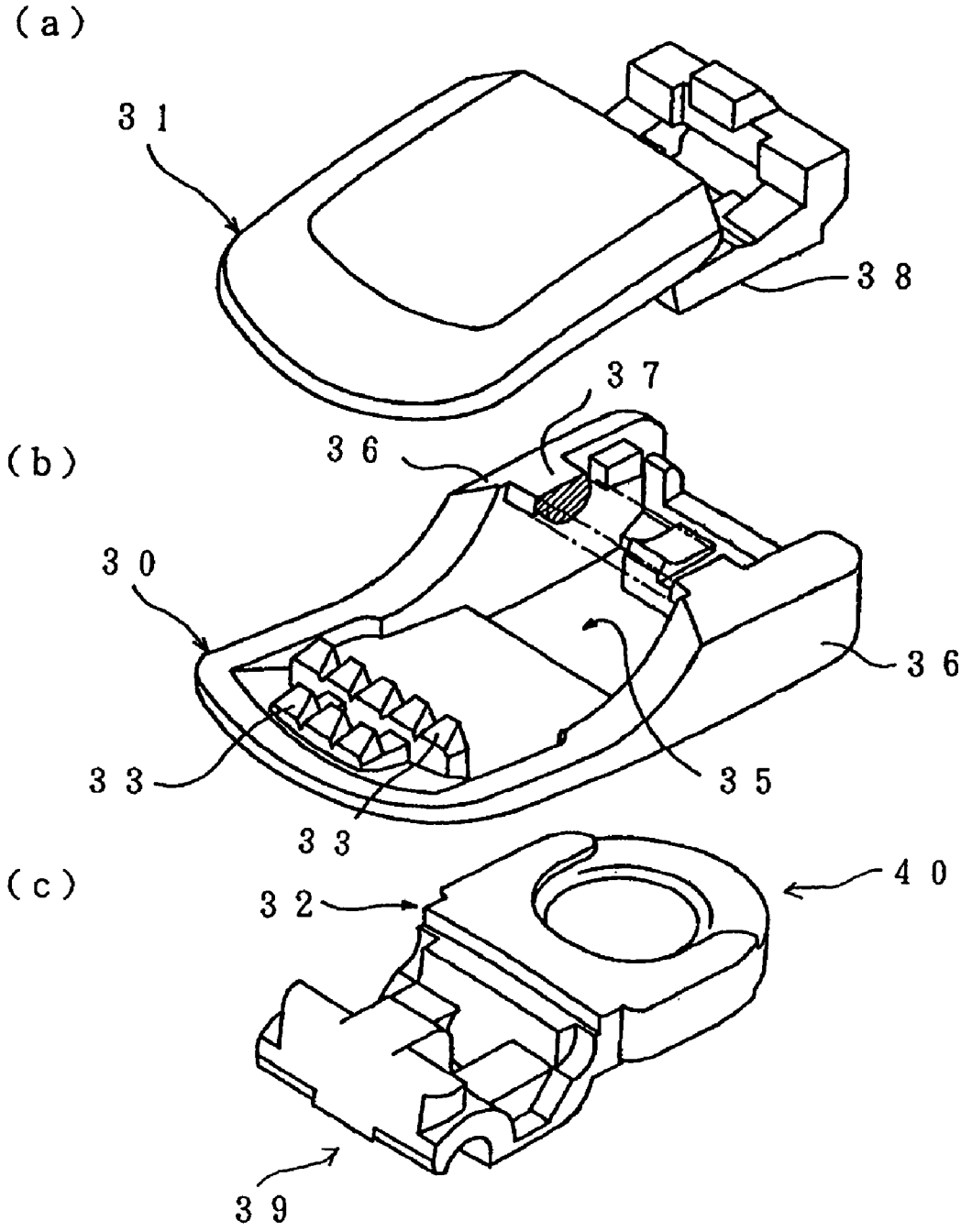
PRIOR ART Fig.25
FIG. 25 (*a*) is a perspective view of the exploded upper clipping member developed already by a prior art of the plastic clip.
Figure 26:
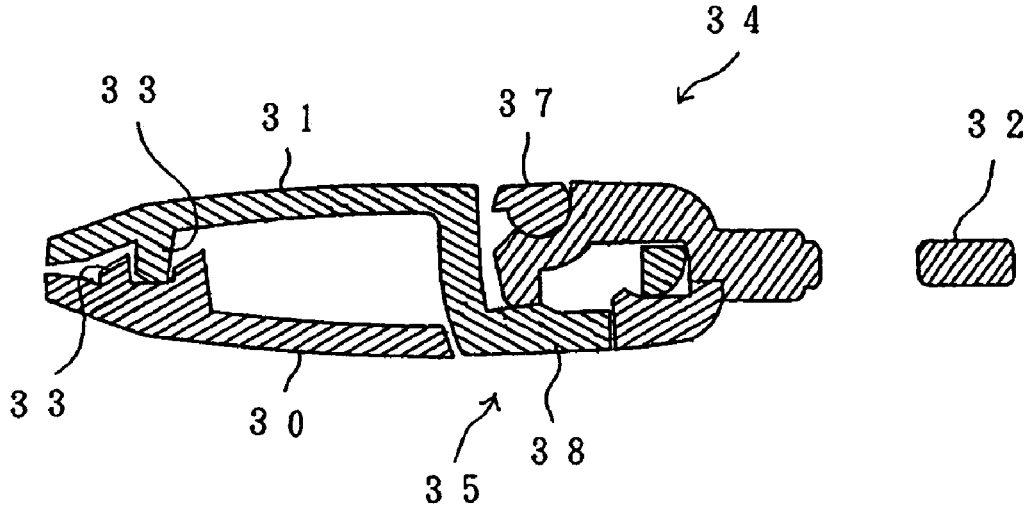
PRIOR ART Fig.26
FIG. 26 is a longitudinal sectional view of the assembled three members along the line running lengthwise a little bit separated from a center line, but in parallel to the line.

The difference between the plastic clip (7) and the old clip (34) developed by the prior art shown in FIG. 25 and FIG. 26 is as follows: As shown in FIG. 19, in the condition where both ends of the lower clipping member (8) and the upper clipping member (9) are closed, a gap (24) is formed between an end side (11*a*) of the combining window (11) and a lower end (14*b*) in a lower portion (14*a*) of the auxiliary plate (14). The width of the gap (24) is prearranged to be in same size with the thickness of the thin plate wall (4) at the fitting ditch (5) prepared in the artificial nail cover (1).

Accordingly, as shown in FIG. 18, in the condition where the both ends of the lower clipping member (8) and the upper clipping member (9) are kept opened, the thin plate wall (4) of the artificial nail cover (1) as shown FIG. 20 is adapted to be inserted into the combining window (11) of the lower clipping member (8), so that the fitting ditch (5) is adapted to be inserted into the end side (11*a*) of the combining window (11). By this assembly procedure, the cover body (2) is applied on the outer surface of the lower clipping member (8).

With reference to FIG. 20, after the cover body (2) of the artificial nail cover (1) is attached to the outer surface of the lower clipping member (8), the operation member (10) is rotated to close both ends of the lower clipping member (8) and the upper clipping member (9), as shown in FIG. 20, and then the thin plate wall (4) is pinched in the gap (24) between the end side (11*a*) of the combining window (11) and the lower end (14*b*) in the lower portion (14*a*) of the auxiliary plate (14). The protruding projection (6) formed on the thin plate wall (4) extends forward over the end side (11*a*) of the combining window (11) in the inside of the clip (7) and the projection (6) becomes a stopper, whereas the pinched thin plate wall (4) does not fall out of the gap (24), and thus the nail cover (1) is to be fixed on the clip (7).

As shown in FIG. 22, the artificial nail cover (1) has a pair of side walls extending downward (3) which pinches tightly and fixedly a pair of side walls (12) of the lower clipping member (8), and the side walls extending downward (3) prevents the nail cover (1) from slipping sideways.

If the nail cover (1) is attached tightly on the clip (7), it is not necessary to prepare the side walls extending downward (3). As the fitting ditch (5) is required to be fitted into the end side (11*a*) of the combining window (11), it is also not necessary to establish this fitting ditch (5) with a curve along the inner surface of the cover body (2). The protruding projection (6) is prepared on the fitting ditch (5), but a recessed fitting ditch (5) can be prepared on the thin plate wall (4). Further, in the clip (7), the support axis (13) of the lower clipping member (8) can be built on the side walls (2) and/or replaced by a pair of protruding axes extending from both sides of the side walls (12).

In this embodiment, the same nail art which is furnished to the one's finger nail can be furnished on the outer surface of the cover body (2) for the artificial nail cover (1), while the thin plate wall (4) is inserted into the combining window (11) to attach the nail cover (1) onto the clip (7). Thus, a clip set combining the nail cover (1) with the plastic clip can be realized. Now, the clip (7) is connected to a strap, and it would enable provision of straps and/or highly fashionable decorative straps. Through this strap connection, the nail cover with some design expressions is then coordinated with the decorated strap, whereby a new art for the nail is now enjoyed by the coordination.

This strap is now set to the cellular phone, while the clip (7) is used on clothes to hold the phone. The nail cover (1) functions as a protective cover and prevents the thread waste in the form of cotton dust from clogging and from entering the gap formed between the auxiliary plate (14) of an upper clipping member (9) and the combining window (11) of a lower clipping member (8).

In the prior art clip (34), if the fitting window (35) is prepared having the gap (24) of the combining window (11) of the present clip (7), the nail cover (1) can be of course attached with the old clip (34).

Second Embodiment

This embodiment explains a clip set combining a nail cover (1) with a clip set (7) according to FIG. 6~FIG. 22. The plastic clip (7) comprises a lower clipping member (8) and an upper clipping member (9) and an operation member (10). The lower clipping member (8) has a curved outer surface like a human nail wherein a combining window (11) is formed toward a rear portion and a pair of side walls (12) is prepared on both sides of the combining window (11) and a support axis (13) is established in an inner surface of the wall (12). The upper clipping member (9) in its rear portion has a recessed auxiliary plate (14) which should be inserted into the combining window (11) of the lower clipping member (8). The operation member (10) controls actuating opening and closing of both ends in the two clipping members (8,9) by rotating itself centering on the support axis (13) and by pressing the auxiliary plate (14). When the operation member (10) is rotated, the auxiliary plate (14) fits together with the combining window (11), whereas both ends of the lower clipping member (8) and the upper clipping member (9) are adapted to tightly close against each other.

Similar to the first embodiment, the artificial nail cover for a clip (1) has a cover body (2) which is curved in its outer surface, and a pair of side walls (3) is formed directing downward on a rear portion of the cover body (2) while the walls (3) face each other. A thin plate wall (4) running toward each wall (3) is prepared in an inner surface of the cover body (2), and a fitting ditch (5) is formed on the thin plate wall (4) along the inner surface of the cover body (2).

Thickness of the combining window (11) prepared on the lower clipping member (8) is almost equal to the thickness where that of the auxiliary plate (14) adds to that of the thin plate wall (4). In other words as shown in FIG. 19, between an end side (11*a*) of the combining window (11) and a lower end (14*b*) in the lower portion (14*a*) of the auxiliary plate (14), a gap (24) which is similar thickness to that of the thin plate wall (4) is formed, while the gap (24) is prearranged to be about same thickness with the thickness of the thin plate wall (4) in the fitting ditch (5). As shown in FIG. 20 and FIG. 21, the lower portion (14*a*) of the auxiliary plate (14) is now freely inserted into or detached from the combining window (11) in the condition that the thin plate wall (4) of an artificial nail cover (1) is fitted into the combining window (11).

Accordingly, in this second embodiment, after the fitting ditch (5) is inserted into the end side (11*a*) of the combining window (11), the lower portion (14*a*) of the auxiliary plate (14) of an upper clipping member (8) is attached movably onto the fitting window (11). By this connection, the artificial nail cover (1) is guaranteed to be fixed and does not fall off the plastic clip (7). As a result, the desirable clip set combining the artificial nail cover (1) with the plastic clip (7) is obtained like the first embodiment.

Third Embodiment

Figure 23:
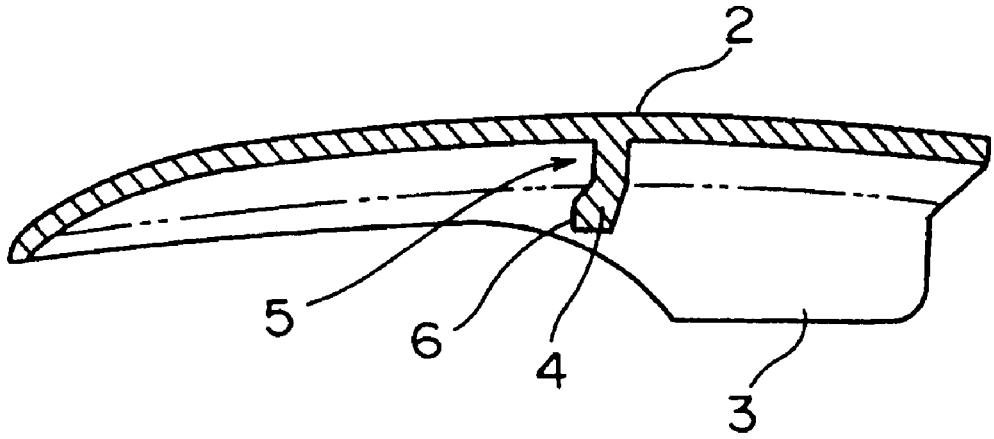
FIG. 23 is a longitudinal sectional view showing a transformed embodiment of the artificial nail cover by the present invention.

This embodiment is a transformed embodiment for an artificial nail cover for a clip (1). FIG. 23 is a longitudinal sectional view of the artificial nail cover (1). In this FIG. 23, the numerals are identical or similar to those used in FIG. 1~FIG. 5. According to FIG. 23, the shape of the cover body (2) is seen where the rear portion is cut off from the cover body (2) as explained in the first embodiment. A pair of side walls (3) are separated at a rear end of the cover body (2).

Figure 24:
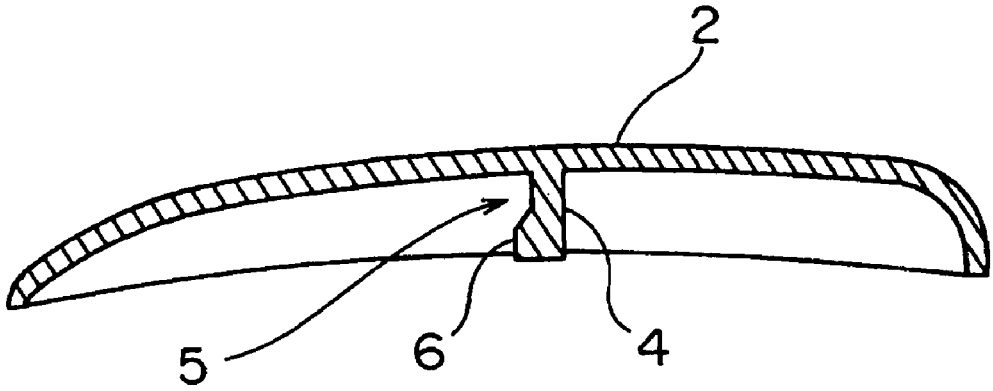
FIG. 24 is a longitudinal sectional view showing another embodiment of the artificial nail cover similar to FIG. 23.

According to FIG. 24, the artificial nail cover (1) does not have any side wall (3) as shown in the same cover (1) explained in the first embodiment.

Even in said transformed embodiments, the thin plate wall (4) is prepared like the first embodiment, and therefore these embodiments can realize their effects similar to the first embodiment.

Now, production method for the actual goods developed by this invention shall be explained as follows.

In accordance with FIG. 1~FIG. 5, an artificial nail cover (1) is prepared in total length of 28.7 mm, width of 12.4 mm and thickness of 0.7 mm, while an outer surface of the same is adapted in a convex curve with R (radial) 8.9 mm like a human nail. In an inner surface of a cover body (2), a thin plate wall (4) in 7.9 mm long, 2.4 mm high at middle of the wall (4), and 0.9 mm thick is formed, and its back side is positioned at a place of 16.3 mm apart from an end of the cover body (2). Further, a protruding project (6) with 0.6 mm height is formed so that it becomes a fitting ditch (5) with a width of 1.1 mm and R8.9 mm. A pair of side walls extending downward (3) is formed at a rear portion 18.5 mm apart from an end of the cover body (2).

According to FIG. 6~FIG. 9, a plastic lower clipping member (8) is prepared in total length of 27.8 mm, width of 12.2 mm and thickness of 1 mm, while the outer surface of the same is adapted to be in a convex curve of R8.9 mm. A square window with 7.8 mm by 7.8 mm size is formed as a combining window (11) separated at 15.3 mm from the end of the lower clipping member (8). Then, in reference to FIG. 10~FIG. 13, an upper clipping member (9) is prepared in total length of 25.5 mm, width of 11 mm and thickness of 1 mm, while its outer surface is adapted to be in a convex curve of R8.9 mm. A lower portion (14*a*) of an auxiliary plate (14) is established in an oblong shape with 8.5 mm lengthwise, 7.6 mm sideways and 1 mm thick. According to FIG. 14~FIG. 16, an operation member (10) is prepared in total length of 17.5 mm which would fit along with the lower clipping member (8) and the upper clipping member (9), and width of 7.4 mm for the front portion (15) of the operation member (10).

Referring to FIG. 17 and FIG. 18, the lower clipping member (8), the upper clipping member (9) and the operation member (10) are assembled and the plastic clip (7) is obtained. As shown in FIG. 19, a gap (24) with 1.2 mm wide is produced when both ends of the lower clipping member (8) and the upper clipping member (9) are closed by rotating the operation member (10).

As shown in FIG. 20, in the condition that the fitting ditch (5) of the nail cover (1) is inserted into an end side (11*a*) of the combining window (11), both ends of the lower clipping member (8) and the upper clipping member (9) can be closed as shown in FIG. 21. In this closed condition, the nail cover (1) cannot be taken apart from the lower clipping member (8). In the opened condition shown in FIG. 20, the nail cover (1) does not fall off even if the clip (7) is forcibly opened. The nail cover (1) can be separated from the clip (7) only when the fitting between the end side (11*a*) of the combining window (11) and the fitting ditch (5) of the nail cover (1) is decomposed.

As explained so far, this invention can provide the artificial nail cover and its relative clip set with beautiful and decorative nail arts optionally, and also the invention can also provide the artificial nail cover as the protective cover.

It is further understood by those skilled in the art that the foregoing description is preferred embodiment of the disclosed goods and that various changes and modifications may be made in this invention without departing from the spirit and scope thereof.

What is claimed is:

1. An artificial nail cover for a clip which comprises:

a cover body extending to an end of the nail cover with a curved surface like a human nail; and a thin plate wall formed in an inner surface of the cover body and running sideways along the cover body;

wherein a fitting ditch is formed on the thin plate wall between the wall and the inner surface of the cover body; and wherein said fitting ditch of said cover is inserted into said clip, thereby attaching the cover to the clip.

2. An artificial nail cover for clip according to claim 1 wherein said fitting ditch is formed in said curve along an inner surface of a cover body.

3. An artificial nail cover for a clip according to claim 1 wherein said fitting ditch is formed in a curve along an inner surface of said cover body.

4. An artificial nail cover for a clip which comprises:

a cover body with a surface curved like a human nail;

the cover body having in a rear portion a pair of side walls directed downward and facing each other;

a thin plate wall formed in an inner surface of the cover body and directed toward each side wall;

wherein a fitting ditch is formed on the thin plate wall between the thin plate wall and an inner surface of the cover body; and wherein said fitting ditch of said cover is inserted into said clip, thereby attaching the cover to the clip.

5. An artificial nail cover for a clip according to claim 4 wherein said fitting ditch is formed in said curve along an inner surface of a cover body.

6. An artificial nail cover for clip according to claim 4 wherein said fitting ditch is formed in a curve along an inner surface of said cover body.

7. A plastic clip composed of a first clipping member having a curved outer surface, wherein a combining window is formed in its rear portion and on both sides of the combining window a pair of side walls is prepared and an support axis is established on inner surfaces of the side walls and a second clipping member has a recessed auxiliary plate in its rear portion, wherein said auxiliary plate is inserted into the combining window of the first clipping member, and an operation member which is rotated centering on the support axis to press said auxiliary plate into the combining window, wherein the operation member controls opening and closing for both ends of the first clipping member and the second clipping member, and by the rotating movement of the operation member both ends are adapted to close together, and an artificial nail cover is attached on the outer surface of the first clipping member, and said nail cover comprising:

a cover body extending toward an end of the nail cover with a surface curved like a human nail;

a thin plate wall formed in an inner surface of the cover body and running sideways along the body cover;

a fitting ditch formed on the thin plate wall between the wall and the inner surface of the cover body;

the thin plate inserted into the combining window of the first clipping member so that the fitting ditch is to be inserted into an end side of the combining window; and wherein the cover body is to be attached on the outer side of the first clipping member.

8. A decorative cover for a clip which comprises:

a decorative cover body with a decorative surface;

the cover body having in a rear portion a pair of side walls directed downward and facing each other;

a thin plate wall formed in an inner surface of the cover body and directed toward each side wall;

wherein a fitting ditch is formed on the thin plate wall between the thin plate wall and an inner surface of the cover body; and wherein said fitting ditch of said cover is inserted into said clip, thereby attaching the cover to the clip.

9. A clip set combining an artificial nail cover with a plastic clip, the set comprising:

artificial nail cover having a cover body extending to an end of the nail cover with a surface curved like a human nail, and having a pair of side walls formed in a rear portion of the cover body, the side walls facing each other, and having a thin plate wall formed in an inner surface of the cover body and running sideways along the cover body, and having a fitting ditch formed on the thin plate wall between the wall and the inner surface of the cover body;

a plastic clip having a first clipping member with a surface curved like the human nail where a combining window is formed in a rear portion of the first clipping member and a pair of side walls are established on both sides of the combining window and a support axis is prepared on an inner surface of the combining window, and having a second clipping member with a recessed auxiliary plate in a rear portion where the auxiliary plate is fitted into the combining window of the first clipping plate, and having an operation member which is rotated centering on the support axis to press the auxiliary plate into the combining window whereas the operation member controls opening and closing for both ends of the first clipping member and the second clipping member and by rotating movement of the operation member ends of the first clipping member and the second clipping member are adapted to close together;

wherein the artificial nail cover and the plastic clip are combined together while the thin plate wall of the nail cover is inserted into the combining window and the fitting ditch is fitted onto an end side of the combining window, where the cover body is attached on the outer surface of one clipping member and the auxiliary plate is pressed and fitted into the combining window by rotating movement of the operation member; and wherein the nail cover is fixed on the plastic clip.

10. A clip set combining a decorative cover with a plastic clip, the set comprising:

a decorative cover having a cover body extending to an end of the decorative cover, and having a pair of side walls formed in a rear portion of the cover body, the side walls facing each other, and having a thin plate wall formed in an inner surface of the cover body and running sideways along the cover body, and having a fitting ditch formed on the thin plate wall between the wall and the inner surface of the cover body;

a plastic clip having a first clipping member with a decorative surface where a combining window is formed in a rear portion of the first clipping member and a pair of side walls are established on both sides of the combining window and a support axis is prepared on an inner surface of the combining window, and having a second clipping member with a recessed auxiliary plate in a rear portion where the auxiliary plate is fitted into the combining window of the first clipping plate, and having an operation member which is rotated centering on the support axis to press the auxiliary plate into the combining window whereas the operation member controls opening and closing for both ends of the first clipping member and the second clipping member and by rotating movement of the operation member ends of the first clipping member and the second clipping member are adapted to close together;

wherein the decorative cover and the plastic clip are combined together while the thin plate wall of the decorative cover is inserted into the combining window and the fitting ditch is fitted onto an end side of the combining window, where the cover body is attached on the outer surface of one clipping member and the auxiliary plate is pressed and fitted into the combining window by rotating movement of the operation member; and wherein the cover is fixed on the plastic clip.

11. A clip composed of a first clipping member having a curved outer surface, wherein a combining window is formed in its rear portion and on both sides of the combining window a pair of side walls is prepared and an support axis is established on inner surfaces of the side walls and a second clipping member has a recessed auxiliary plate in its rear portion, wherein said auxiliary plate is inserted into the combining window of the first clipping member, and an operation member which is rotated centering on the support axis to press said auxiliary plate into the combining window, wherein the operation member controls opening and closing for both ends of the first clipping member and the second clipping member, and by the rotating movement of the operation member both ends are adapted to close together, and a decorative cover is attached on the outer surface of the first clipping member, and said nail cover comprising:

a cover body extending toward an end of the decorative cover;

a thin plate wall formed in an inner surface of the cover body and running sideways along the body cover;

a fitting ditch formed on the thin plate wall between the wall and the inner surface of the cover body;

the thin plate inserted into the combining window of the first clipping member so that the fitting ditch is to be inserted into an end side of the combining window; and wherein the cover body is to be attached on the outer side of the first clipping member.

* * * * *